US009030514B2

(12) United States Patent
Tsuchiya

(10) Patent No.: US 9,030,514 B2
(45) Date of Patent: May 12, 2015

(54) LIGHT SCANNING DEVICE AND IMAGE FORMING APPARATUS

(71) Applicant: Fuji Xerox Co., Ltd., Tokyo (JP)

(72) Inventor: Ken Tsuchiya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 14/287,671

(22) Filed: May 27, 2014

(65) Prior Publication Data

US 2015/0103128 A1 Apr. 16, 2015

(30) Foreign Application Priority Data

Oct. 10, 2013 (JP) ..... 2013-213042

(51) Int. Cl.
*G03G 15/00* (2006.01)

(52) U.S. Cl.
CPC ..... *G03G 15/80* (2013.01)

(58) Field of Classification Search
CPC ..... B41J 2/47; B41J 2/45; H01S 3/00; G03G 15/80
USPC ..... 347/238, 247
See application file for complete search history.

(56) References Cited

U.S. PATENT DOCUMENTS

2005/0078723 A1 * 4/2005 Han et al. ..... 372/38.02

FOREIGN PATENT DOCUMENTS

| | | |
|---|---|---|
| JP | A-10-297017 | 11/1998 |
| JP | A-2003-156929 | 5/2003 |
| JP | A-2003-182141 | 7/2003 |
| JP | A-2003-182143 | 7/2003 |
| JP | A-2005-053145 | 3/2005 |
| JP | A-2008-093896 | 4/2008 |
| JP | 2009143242 A * | 7/2009 |

* cited by examiner

*Primary Examiner* — Sarah Al Hashimi
(74) *Attorney, Agent, or Firm* — Oliff PLC

(57) ABSTRACT

A light scanning device includes a scanning unit and a power consumption unit. The scanning unit faces a scan surface and performs scanning by dividing one scan area into segments by having multiple light-emitting-element groups arranged in a predetermined scanning direction. Each light-emitting-element group writes an image onto the scan surface by causing multiple light-emitting elements arranged in the scanning direction to emit light in a time-division manner based on image information. The power consumption unit operates during a non-writing period occurring between scanning processes repeatedly executed in each light-emitting-element group, so as to cause consumption of electric power corresponding to electric power consumed for light emission in the light-emitting-element group.

7 Claims, 12 Drawing Sheets

LIGHT SCANNING DEVICE AND IMAGE FORMING APPARATUS

CROSS-REFERENCE TO RELATED APPLICATIONS

This application is based on and claims priority under 35 USC 119 from Japanese Patent Application No. 2013-213042 filed Oct. 10, 2013.

BACKGROUND

Technical Field

The present invention relates to light scanning devices and image forming apparatuses.

SUMMARY

According to an aspect of the invention, there is provided a light scanning device including a scanning unit and a power consumption unit. The scanning unit faces a scan surface and performs scanning by dividing one scan area into segments by having multiple light-emitting-element groups arranged in a predetermined scanning direction. Each light-emitting-element group writes an image onto the scan surface by causing multiple light-emitting elements arranged in the scanning direction to emit light in a time-division manner based on image information. The power consumption unit operates during a non-writing period occurring between scanning processes repeatedly executed in each light-emitting-element group, so as to cause consumption of electric power corresponding to electric power consumed for light emission in the light-emitting-element group.

BRIEF DESCRIPTION OF THE DRAWINGS

An exemplary embodiment of the present invention will be described in detail based on the following figures, wherein.

DETAILED DESCRIPTION

Overall Configuration

Figure 1:
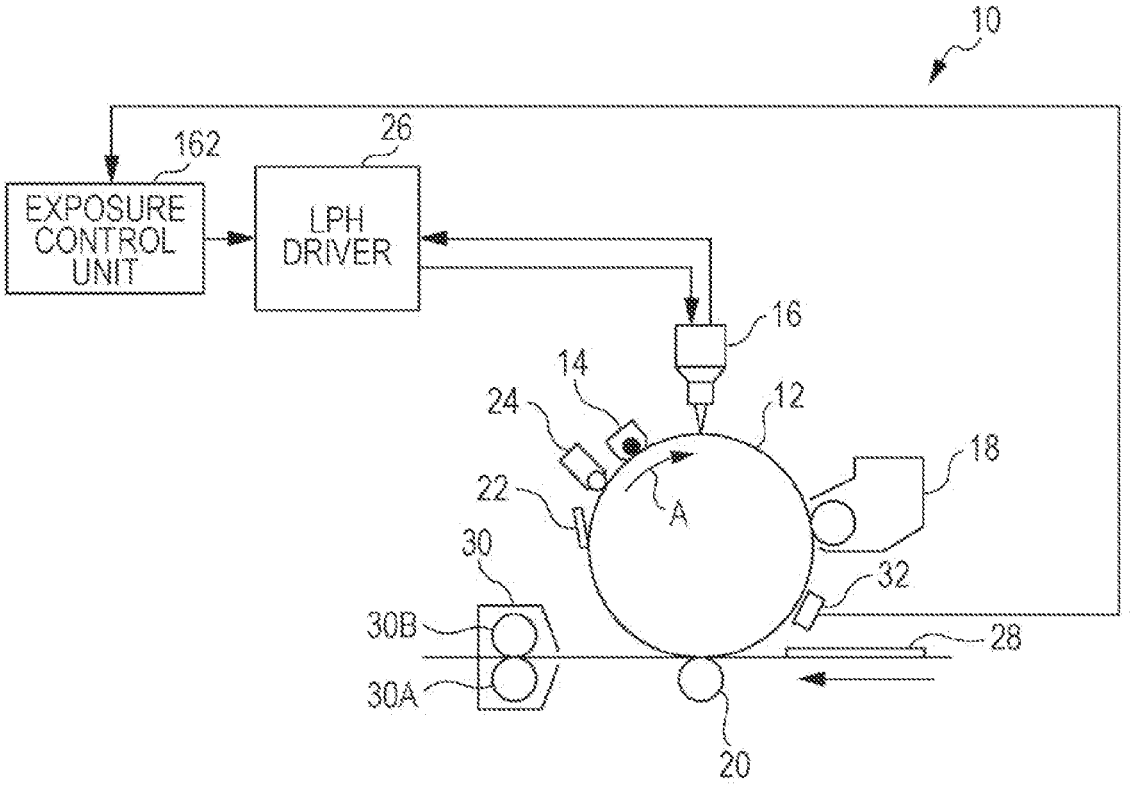
FIG. 1 schematically illustrates the overall configuration of an engine section of an image forming apparatus according to an exemplary embodiment.

FIG. 1 schematically illustrates the overall configuration of an engine section 10 of an image forming apparatus according to an exemplary embodiment of the present invention. As shown in FIG. 1, the engine section 10 includes a photoconductor drum 12 that rotates at constant speed in a direction indicated by an arrow A in FIG. 1.

The photoconductor drum 12 is surrounded by a charging unit 14, a light-emitting-diode (LED) printer head (LPH) 16, a developing unit 18, a transfer roller 20, a cleaner 22, and an erase lamp 24 in this order in the rotational direction (i.e., a clockwise direction indicated by the arrow A in FIG. 1) of the photoconductor drum 12.

Specifically, the surface of the photoconductor drum 12 is uniformly charged by the charging unit 14. Then, the photoconductor drum 12 is irradiated with a light beam from the LPH 16 so that a latent image is formed on the photoconductor drum 12. The LPH 16 is connected to an LPH driver 26 and is configured to emit a light beam based on image data by being controlled by the LPH driver 26.

The latent image formed on the photoconductor drum 12 by the light beam is supplied with toner from the developing unit 18 so that a toner image is formed on the photoconductor drum 12.

The transfer roller 20 transfers the toner image on the photoconductor drum 12 onto a sheet 28 transported from a sheet tray (not shown). After the transfer process, residual toner on the photoconductor drum 12 is removed therefrom by the cleaner 22. Then, the erase lamp 24 diselectrifies the photoconductor drum 12. Subsequently, the photoconductor drum 12 is electrostatically charged by the charging unit 14 again. The same process described above, is repeated.

The sheet 28 having the toner image transferred thereon is transported to a fixing unit 30, which includes a pressing roller 30A and a heating roller 30B, where the sheet 28 undergoes a fixing process. Thus, the toner image becomes fixed onto the sheet 28, whereby a desired image is formed on the sheet 28. The sheet 28 having the image formed thereon is discharged outside the apparatus.

Furthermore, a density detection circuit 32 that faces the photoconductor drum 12 is provided on the periphery of the photoconductor drum 12 and between the developing unit 18 and the transfer roller 20. For example, when a density patch pattern (i.e., a density sample) is formed, the density detection circuit 32 detects the density of the toner image on the photoconductor drum 12. An output terminal of this density detection circuit 32 is connected to an exposure control unit 162. The exposure control unit 162 is connected to the LPH driver 26 for driving the LPH 16. The LPH driver 26 is connected to the LPH 16.

As the aforementioned density patch pattern, a patch pattern with an extremely small size of about several hundreds of micrometers by several hundreds of micrometers is used. By using this density patch pattern, the density may be detected by the density detection circuit 32 facing the photoconductor drum 12 without having to print the density patch pattern onto the sheet 28.

The density detection circuit 32 is attached to a moving mechanism that is movable in a main scanning direction, and is capable of detecting the density of the density patch pattern in the main scanning direction.

Engine-Section Control System

Figure 2:
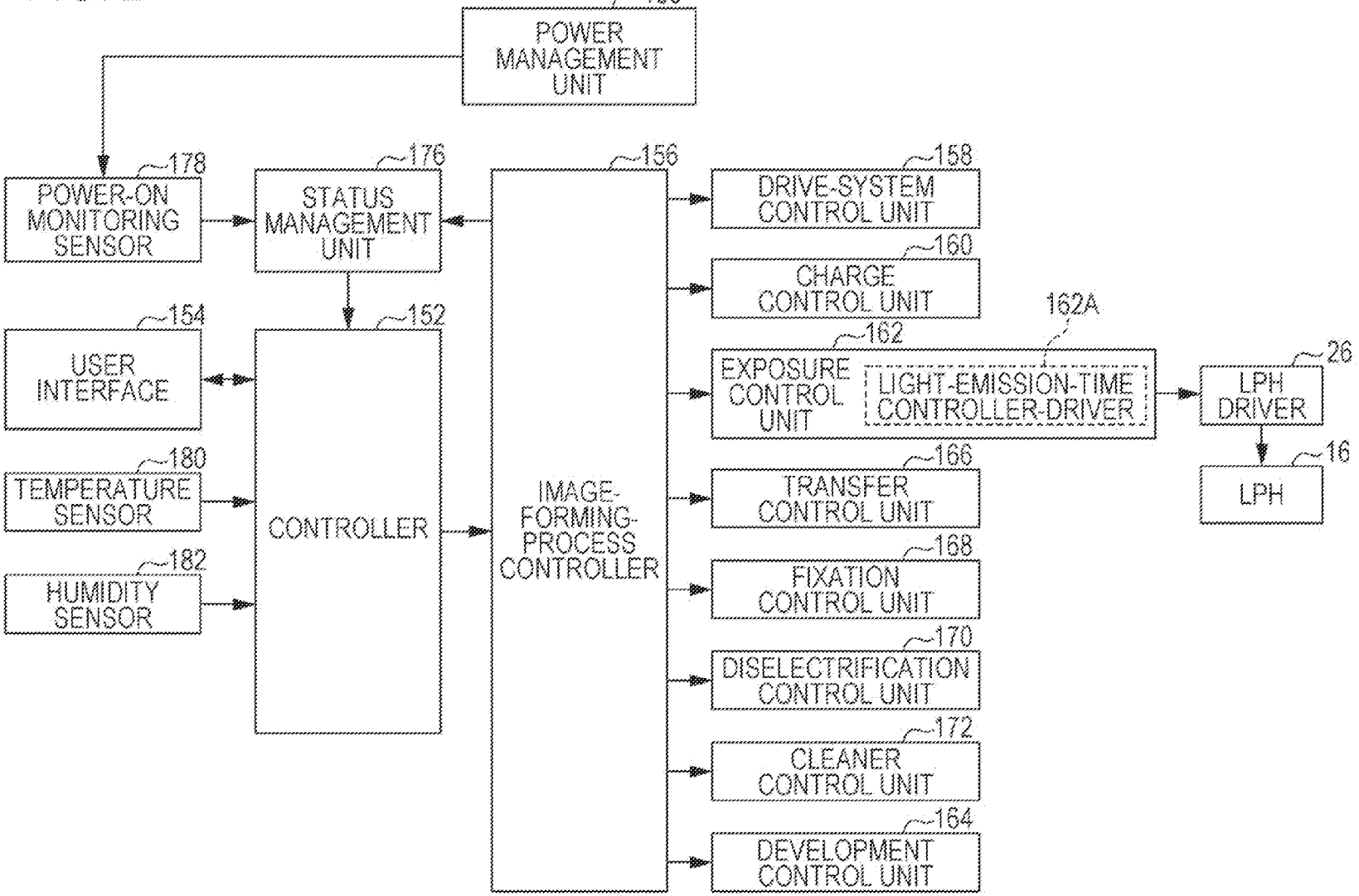
FIG. 2 is a block diagram of an image-formation control system in the engine section according to the exemplary embodiment.

FIG. 2 is a block diagram of an image-formation control system in the engine section 10.

A power management unit 150 is connected to a commercial power source (not shown). The power management unit 150 generates a low-voltage power supply (LVPS) and a high-voltage power supply (HVPS) and supplies electric power to each unit via a power supply line.

A controller 152 is connected to a user interface 154. The controller 152 receives a command related to, for example, an image forming process from user's operation and also notifies the user of information about, for example, an image forming process.

Furthermore, the controller 152 is connected to an external host computer (not shown) via a network line and is configured to receive image data.

When the controller 152 receives the image data, the controller 152 analyzes, for example, the image data and print command information included in the image data, converts the data into a format (e.g., bitmap data) suitable for the engine section 10, and then transmits the image data to an image-forming-process controller 156 functioning as a part of an MCU.

Based on the input image data, the image-forming-process controller 156 synchronously controls the image-forming-process controller 156 as well as a drive-system control unit 158, a charge control unit 160, the exposure control unit 162, a transfer control unit 166, a fixation control unit 168, a diselectrification control unit 170, a cleaner control unit 172, and a development control unit 164, which function as the MCU, so as to execute an image forming process.

The LPH driver 26 is controlled by a light-emission-time controller-driver 162A provided in the exposure control unit 162.

The image-forming-process controller 156 is connected to a status management unit 176 that determines the operation status of the engine section 10 (e.g., a processing mode, a sleep mode, a start-up from the sleep mode, and an in-progress mode). The operation status determined in the status management unit 176 is transmitted to the controller 152.

Furthermore, the power management unit 150 is connected to a power-on monitoring sensor 178. The power-on monitoring sensor 178 detects that the power is turned on and transmits the power-on information to the controller 152 via the status management unit 176.

The controller 152 is also connected to, for example, a temperature sensor 180 and a humidity sensor 182. The temperature sensor 180 and the humidity sensor 182 respectively detect an ambient temperature and an ambient humidity within the engine section 10.

Detailed Configuration of LPH

Figure 3:
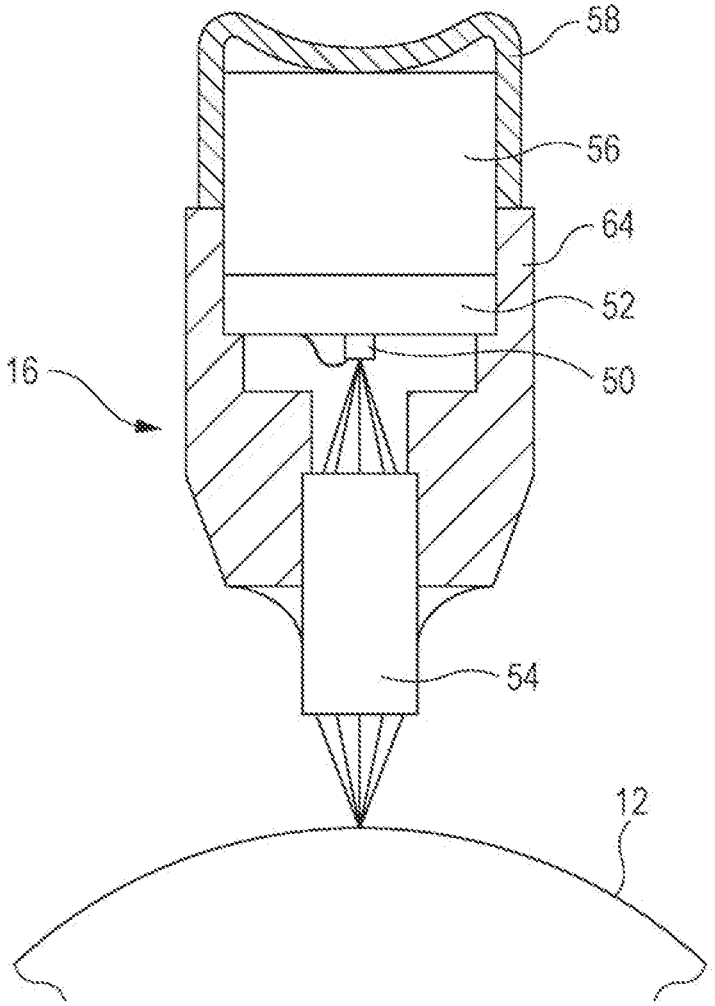
FIG. 3 is an enlarged view illustrating the structure of a light-emitting-diode printer head (LPH) according to the exemplary embodiment.

Next, the configuration of the LPH 16 will be described in detail. As shown in FIG. 3, the LPH 16 includes an LED array 50, a printed circuit board 52 that supports the LED array 50 and has a circuit for supplying various signals used for controlling the driving of the LED array 50, and a Selfoc (registered trademark) lens array (SLA) 54.

The printed circuit board 52 is disposed within a housing 56 such that an attachment surface of the LED array 50 faces the photoconductor drum 12, and is supported by a leaf spring 58.

Figure 4:
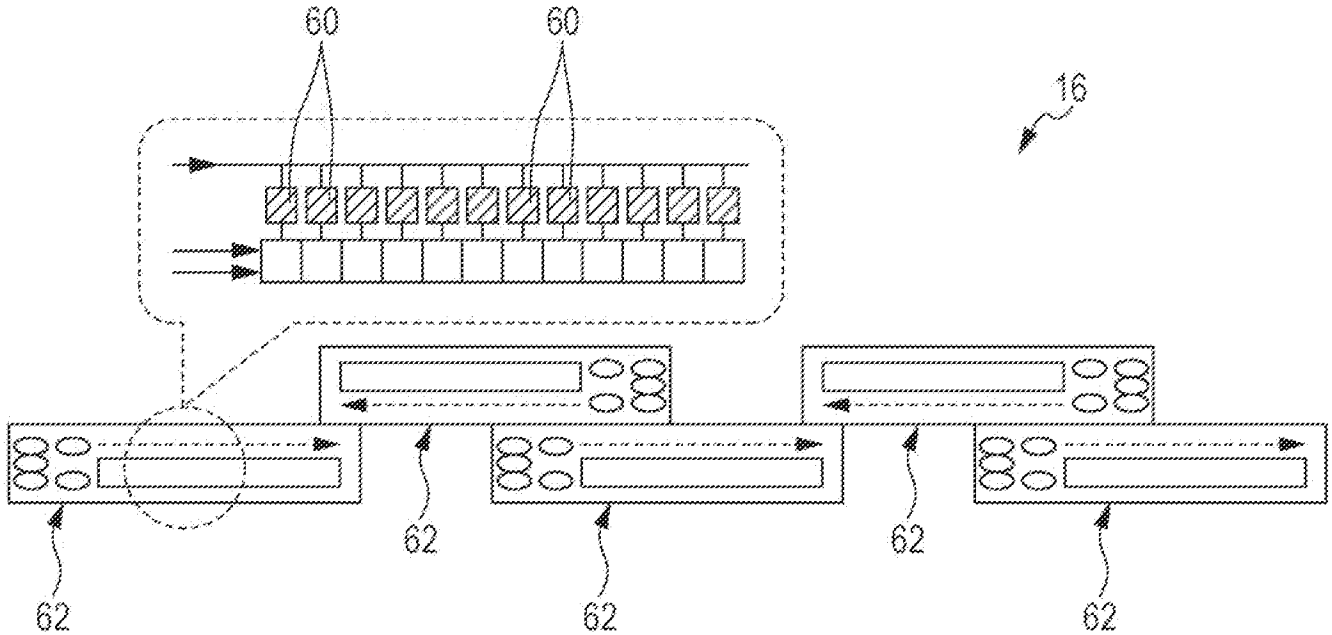
FIG. 4 is a plan view illustrating an arrangement configuration of self-scanning light-emitting diodes (SLEDs) according to the exemplary embodiment.

As shown in FIG. 4, self-scanning LED (SLED) chips 62 each having multiple LEDs 60 arranged in the axial direction of the photoconductor drum 12 are arranged in a so-called zigzag pattern and are capable of radiating light beams with predetermined resolution in the axial direction of the photoconductor drum 12.

Figure 5A:
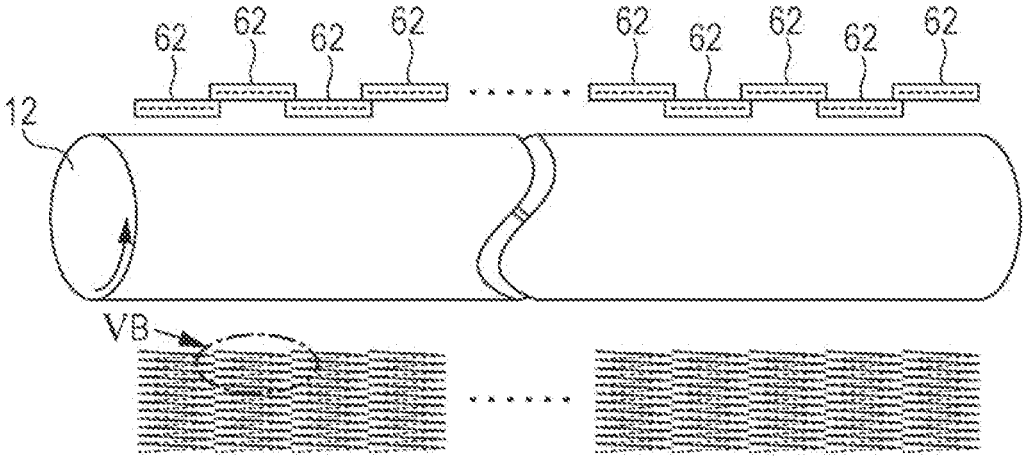
FIG. 5A is a front view illustrating a main scanning process based on a relative positional relationship between a photoconductor drum and the LPH.

As shown in FIG. 5A, with regard to the SLED chips 62 arranged in the zigzag pattern, a scanning process (main scanning process) is repeated by each SLED chip 62, and the photoconductor drum 12 is rotated about its axis (sub scanning process).

Figure 5B:
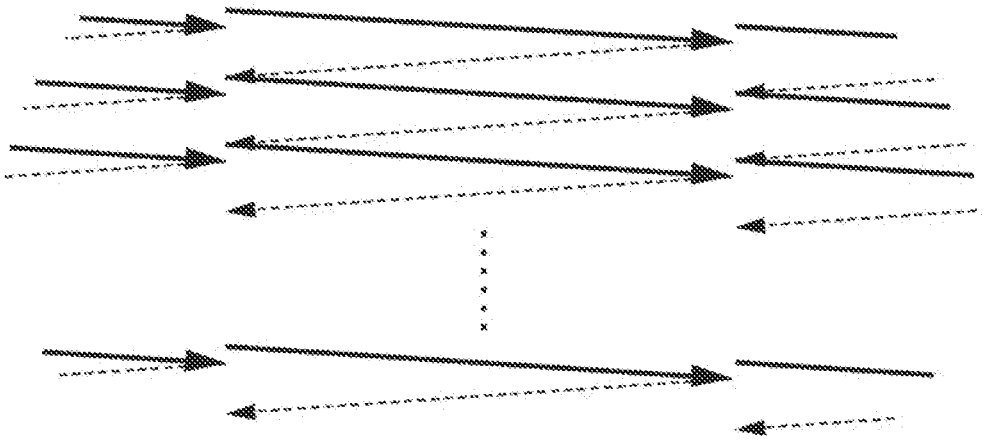
FIG. 5B is an enlarged view of a dotted-chain line area VB in FIG. 5A.

In other words, as shown in FIG. 5B, a main scanning line on the photoconductor drum 12 is formed as a single main scanning line constituted of a combination of contemporaneous main scanning lines scanned by the zigzag-arranged SLED chips 62. Although the combined main scanning line forms a so-called saw-shaped pattern when viewed microscopically, the combined main scanning line may be regarded as a straight line in a condition in which main scanning lines form an image of a single page.

In FIG. 5B, thick arrows each correspond to a writing period in which the photoconductor drum 12 is exposed to light, and each dotted arrow in FIG. 516 denotes an interval between main scanning processes and corresponds to a non-writing period (i.e., an idle period) in which the photoconductor drum 12 is not exposed to light.

In this exemplary embodiment, in each non-writing period (i.e., a period from the end of a previous scanning process to the start of a subsequent scanning process), the LEDs 60 in each SLED chip 62 emit light with a light quantity that does not cause the photoconductor drum 12 to undergo exposure. Detailed descriptions of light-emission control based on image data in each writing period and forced-light-emission control in each non-writing period will be provided later.

Light-Emission-Time Controller-Driver

The light-emission-time controller-driver 162A provided in the exposure control unit 162 will now be described in detail with reference to FIG. 6.

The light-emission-time controller-driver 162A corrects a light-emission time for each pixel based on nonuniform-density correction data and generates a control signal for causing the LED 60 of each pixel to emit light.

Figure 6:
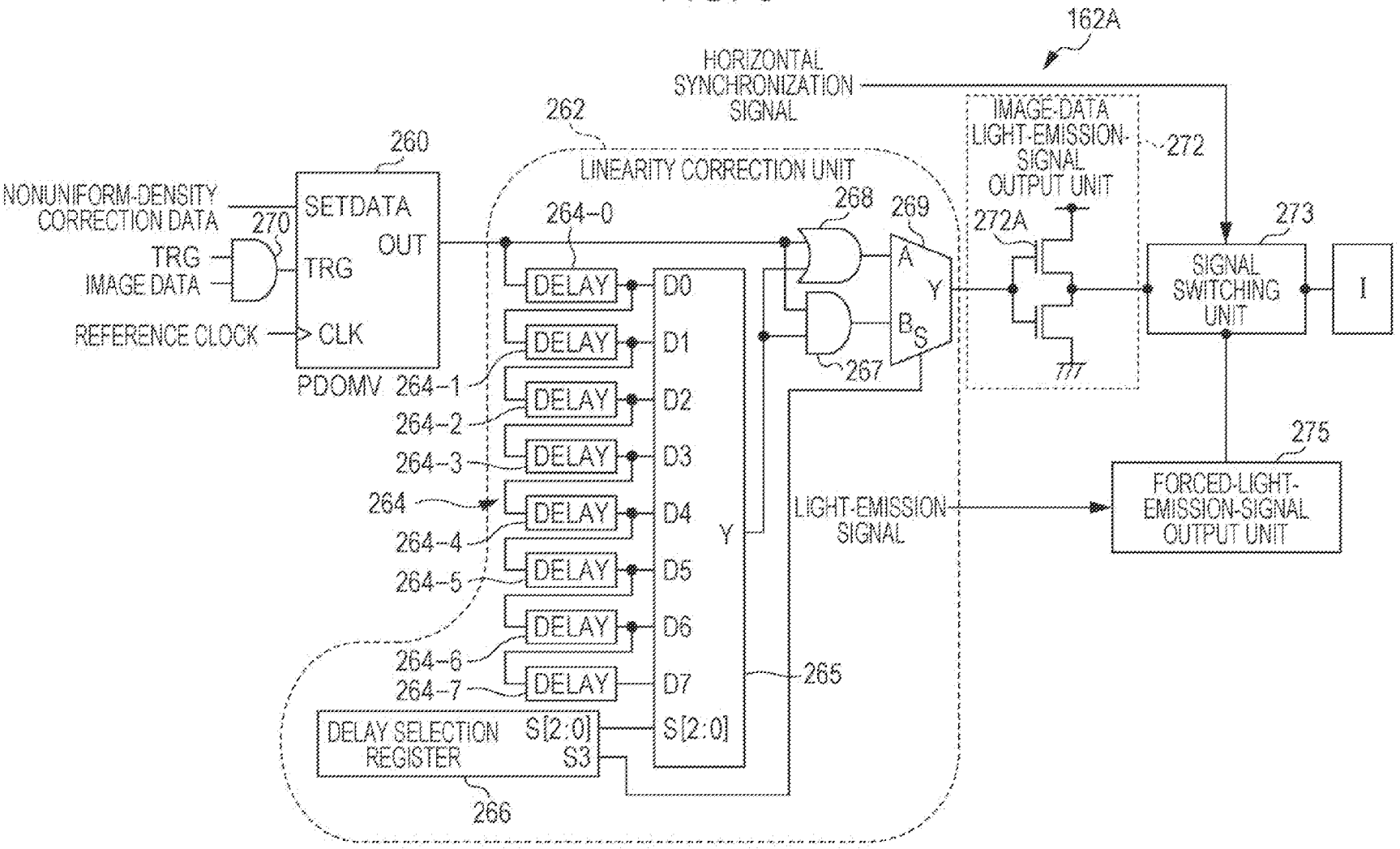
FIG. 6 is a control block diagram of a light-emission-time controller-driver.

As shown in FIG. 6, the light-emission-time controller-driver 162A includes a pre-settable digital one-shot multivibrator (PDOMV) 260, a linearity correction unit 262, and an AND circuit 270. The AND circuit 270 receives a trigger signal when the image data is 1 (ON) and does not receive a trigger signal when the image data is 0 (OFF).

The PDOMV 260 receives nonuniform-density correction data and a reference clock in synchronization with the trigger signal from the AND circuit 270 and generates a light-emission pulse signal.

The linearity correction unit 262 corrects and outputs the light-emission pulse signal from the PDOMV 260 so as to correct a variation in light-emission start time of each driver output.

Specifically, the linearity correction unit 262 has multiple (eight in this exemplary embodiment) delay circuits 264 (the numbers 0 to 7 provided as suffixes to the reference numeral 264 are for differentiating between the individual delay circuits 264), a delay selection register 266, a delay-signal selecting unit 265, an AND circuit 267, an OR circuit 268, and a light-emission-signal selecting unit 269.

The delay circuits 264 (i.e., the delay circuits 264-0 to 264-7) are connected to the PDOMV 260 and delay the light-emission pulse signal from the PDOMV 260 by different times.

The delay selection register 266 is connected to the delay-signal selecting unit 265 and the light-emission-signal selecting unit 269. The delay selection register 266 stores therein delay selection data for each driver and light-emission-signal selection data.

The delay selection data for each driver and the light-emission-signal selection data are measured in advance and are stored in a nonvolatile memory (not shown), such as an electrically erasable and programmable read-only memory (EEPROM) or a flash read-only memory (ROM). In a case where the delay selection data for each driver and the light-emission-signal selection data are stored in the EEPROM, the delay selection data is downloaded into the delay selection register 266 when the apparatus is turned on. In a case where the delay selection data for each driver and the light-emission-signal selection data are stored in the flash ROM, the flash ROM functions as the delay selection register 266.

The delay-signal selecting unit 265 is connected to the AND circuit 267 and the OR circuit 68 and selects any one of outputs from the delay circuits 264-0 to 264-7 based on the delay selection data stored in the delay selection register 266.

The AND circuit 267 outputs a light-emission pulse if a logical product of the light-emission pulse signal from the PDOMV 260 and a delay light-emission pulse signal selected by the delay-signal selecting unit 265 is in a light-emission state, that is, if both the pre-delayed light-emission pulse signal and the delayed light-emission pulse signal are in a light-emission state.

The OR circuit 268 outputs a light-emission pulse if a logical sum of the light-emission pulse signal from the PDOMV 260 and the delay light-emission pulse signal selected by the delay-signal selecting unit 265 is in a light-emission state, that is, if at least one of the pre-delayed light-emission pulse signal and the delayed light-emission pulse signal is in a light-emission state.

The light-emission-signal selecting unit 269 selects one of outputs from the AND circuit 267 and the OR circuit 268 based on the light-emission-signal selection data stored in the delay selection register 266.

The light-emission-signal selecting unit 269 is connected to an image-data light-emission-signal output unit 272. A metal-oxide semiconductor field-effect transistor (MOSFET) 272A may be used as the image-data light-emission-signal output unit 272.

In the image-data light-emission-signal output unit 272, a light-emission time according to the image data is generated based on a predetermined light quantity and is transmitted to drive circuits of the SLED chips 62 via a signal switching unit 273 so as to be used as a light-emission control signal (I).

The signal switching unit 273 is connected to a forced-light-emission-signal output unit 275. The forced-light-emission-signal output unit 275 constantly outputs a light-emission signal toward the signal switching unit 273.

Furthermore, the signal switching unit 273 receives a horizontal synchronization signal. Based on this horizontal synchronization signal, the signal switching unit 273 switches an output source for the light-emission control signal (I) to the image-data light-emission-signal output unit 272 or the forced-light-emission-signal output unit 275. The light-emission signal to be input to the forced-light-emission-signal output unit 275 is preliminarily limited to an exposure light quantity that does not lead to exposure.

SLED Drive Circuit

Figure 7:
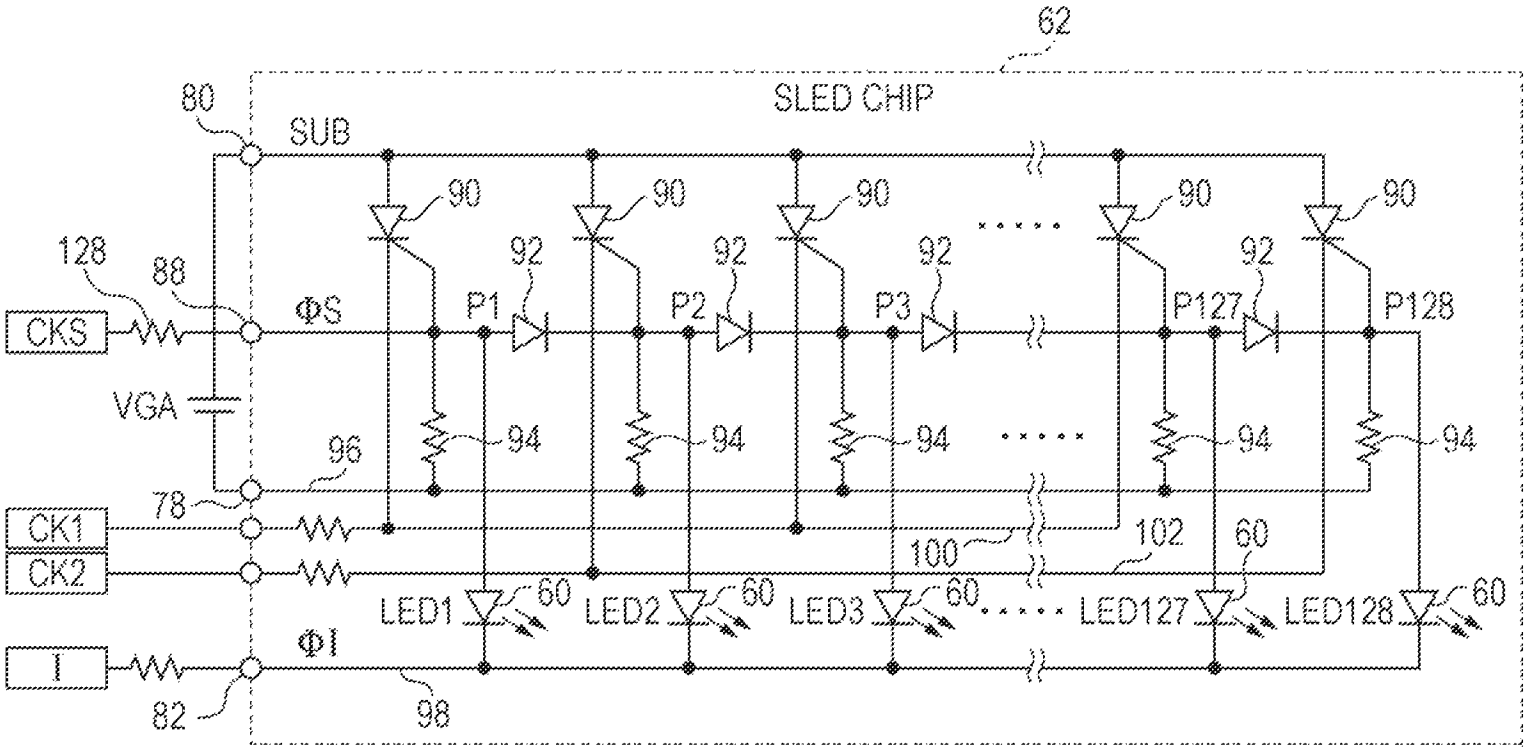
FIG. 7 is a light-emission control circuit diagram of an SLED chip according to the exemplary embodiment.

Next, an internal circuit configuration provided in each SLED chip 62 for driving the LEDs 60 in the SLED chip 62 will be described with reference to FIG. 7.

With regard to each SLED chip 62, the multiple (e.g., 128) LEDs 60 arranged within the SLED chip 62 are individually provided with thyristors 90. The anodes of the thyristors 90 are connected to a SUB terminal 80.

A point P (the numbers 1 to 128 added as suffixes to points P denote the order of multiple arranged LEDs 60) connected to the gate of the thyristor 90 in the first stage is connected to a ϕS input terminal 88. As a trigger for causing the LEDs 60 in the SLED chip 62 to emit light, a start signal ϕS (voltage) is applied to the points P (P1 to P128).

The points P (P1 to P128 ) connected to the gates of the thyristors 90 in the respective stages are connected to each other in series via diodes 92. Furthermore, the points P (P1 to P128) in the respective stages are connected, via resistors 94, to a base line 96 that is connected to a video-graphics-array (VGA) terminal 78. The base line 96 maintains a predetermined voltage in the first stage and decrements the voltage by a predetermined potential (Vf) with increasing stages.

The points P (P1 to P128) are connected to the anodes of the LEDs 60. The cathodes of the LEDs 60 are connected to a ϕI input terminal 82 via a light-emission control signal line 98 that outputs a pulse wave acting as the light-emission control signal (I) in each stage. When this light-emission control signal is at a low level (L), the LEDs 60 emit light if the thyristors 90 with the points P (P1 to P128) acting as gates are turned on.

The cathodes of the thyristors 90 in the odd-numbered stages are connected to a first transmission line 100, and the cathodes of the thyristors 90 in the even-numbered stages are connected to a second transmission line 102, such that transmission signals CK1 and CK2 are supplied. In accordance with these transmission signals CK1 and CK2, the potential at each of the points P (P1 to P128) is incremented by a predetermined potential (Vf). Specifically, the potentials at the points P reach predetermined potentials, which may cause the LEDs 60 to emit light, sequentially from the point P1 in the first stage to the points P in the subsequent stages, thereby allowing for self-scanning of the SLED chip 62.

Forced-Light-Emission Control

Figure 8A:
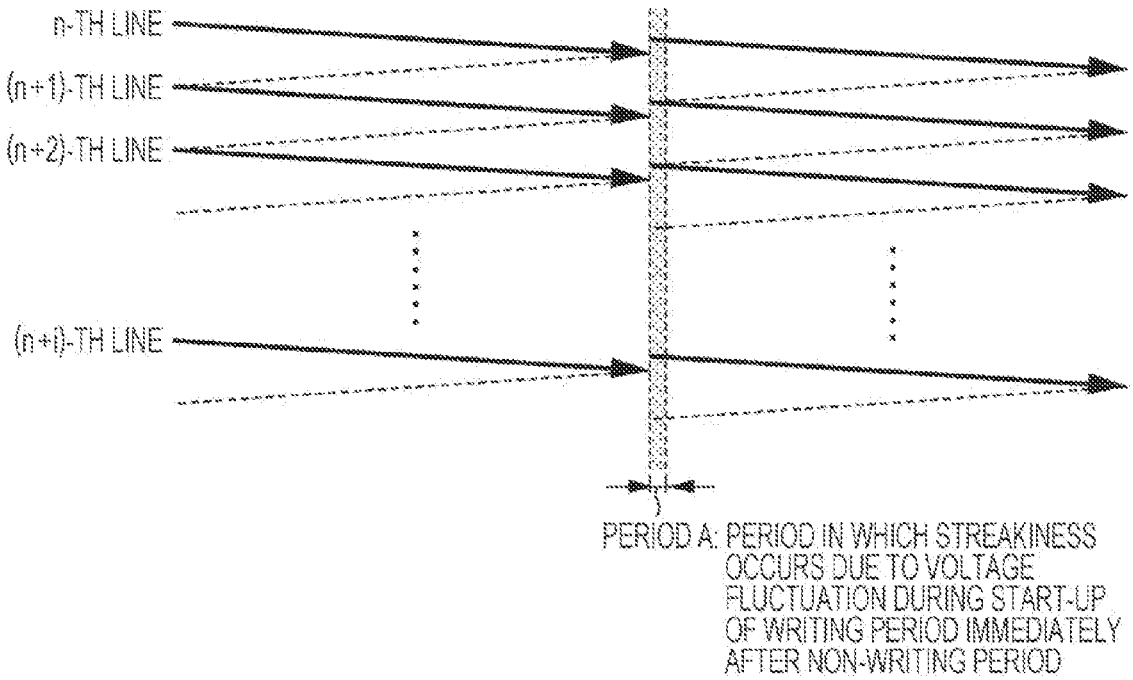
FIG. 8A is a characteristic diagram illustrating writing periods and non-writing periods in a main scanning line of each SLED chip shown in FIG. 5B.

As shown in FIG. 8A, due to the photoconductor drum 12 rotating at constant speed, the main scanning lines by the SLED chips 62 are sub-scanned in the following order: n-th line, (n+1)-th line, (n+2)-th line, . . . , (n+i)-th line.

In this case, as shown in FIG. 8E, each main scanning line has non-writing periods as intervals between writing periods. The LEDs 60 emit light in each writing period, whereas the LEDs 60 do not emit light in each non-writing period, thus causing a voltage fluctuation to occur between the writing period and the non-writing period. As indicated by a period A in FIG. 8, a lack of light quantity caused by the voltage fluctuation occurs during a start-up of a writing period, leading to the occurrence of streakiness (see a dotted line (comparative example) in FIG. 9).

Figure 9:
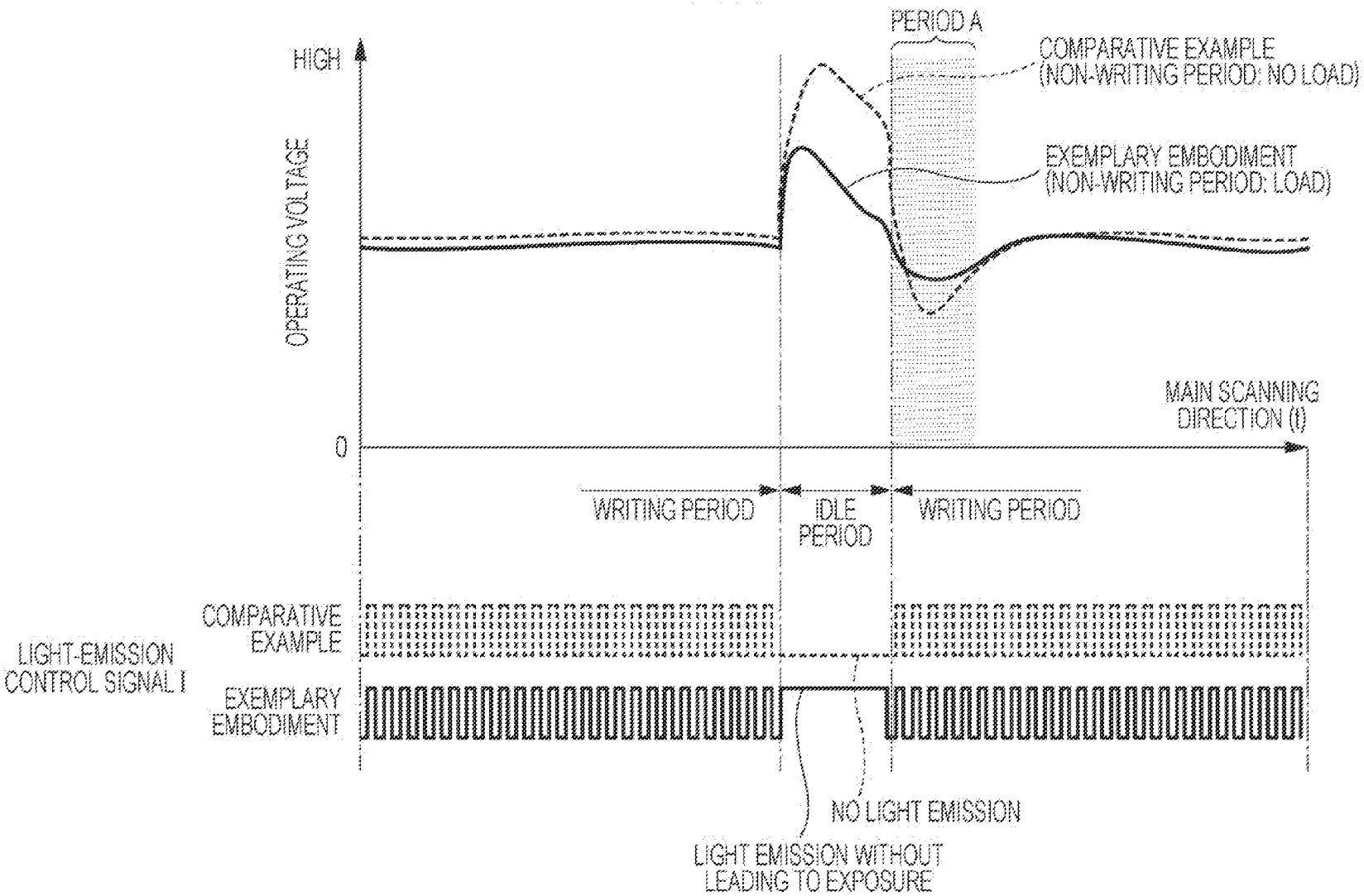
FIG. 9 is a characteristic diagram illustrating an operating-voltage fluctuation based on main scanning processes (times) between adjacent SLED chips arranged in a main scanning direction.

In this exemplary embodiment, the LEDs 60 are forcedly made to emit light with an exposure light quantity that does not lead to exposure even during a non-writing period (i.e., an idle period), so that the voltage fluctuation may be suppressed (see a solid line (exemplary embodiment) in FIG. 9) as compared with a case where the LEDs 60 do not emit light, thereby preventing a lack of light quantity during a start-up of each SLED chip 62.

In this exemplary embodiment, the signal switching unit 273 is provided at a terminal of the light-emission-time controller-driver 162A as a unit for forcedly making the LEDs 60 emit light during a non-writing period in the above-described manner. Based on a horizontal synchronization signal, the signal switching unit 273 switches the output source for the light-emission control signal (I) to the image-data light-emission-signal output unit 272 or the forced-light-emission-signal output unit 275.

Figure 8B:
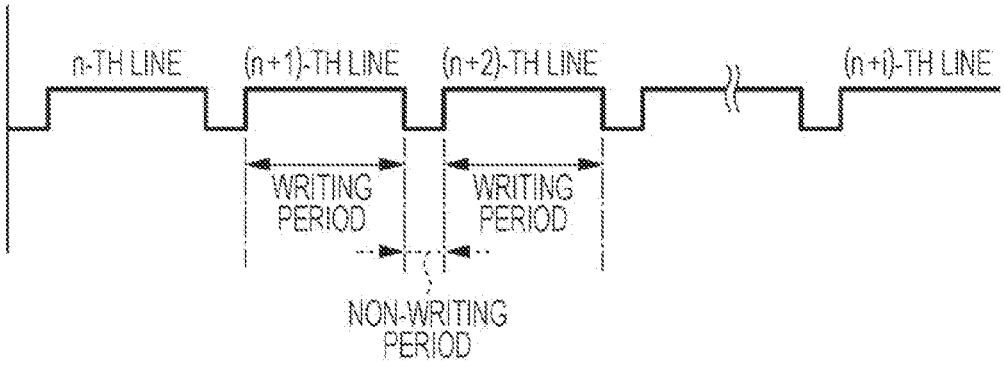
FIG. 8B is a timing chart of the writing periods and the non-writing periods in the main scanning line of the SLED chip.

More specifically, based on a horizontal synchronization signal, the signal switching unit 273 switches the output source to the image-data light-emission-signal output unit 272 during each writing period (see FIGS. 8A and 8B), and switches the output source to the forced-light-emission-signal output unit 275 during each non-writing period (see FIGS. 8A and 8B). A light-emission signal to be input to the forced-light-emission-signal output unit 275 is preliminarily limited to an exposure light quantity that does not lead to exposure. As a result, the light-emission control signal (I) is changed from the comparative example indicated by the dotted line in FIG. 9 to this exemplary embodiment indicated by the sold line in FIG. 9, so that electric power is continuously consumed even during a non-writing period (i.e., an idle period), whereby a voltage fluctuation may be suppressed.

The operation of this exemplary embodiment will be described below.

Image Forming Process

A known electrophotographic image forming (printing) process is performed for each color around the periphery of the corresponding photoconductor drum 12 in the following manner.

First, the photoconductor drum 12 is rotationally driven at a predetermined rotation speed.

Then, as shown in FIG. 1, the charging unit 14 applies a direct-current voltage at a predetermined charge level (or a voltage in which alternating-current voltage is superimposed on direct-current voltage) onto the surface of the photoconductor drum 12 so as to uniformly charge the surface of the photoconductor drum 12 to a predetermined level.

Subsequently, the PPM 16 causes the LEDs 60 to radiate a light beam onto the uniformly charged surface of the photoconductor drum 12, so that an electrostatic latent image according to image information is formed on the surface. The light-emission control of the LEDs 60 will be described later.

With the light emission from the LEDs 60, the surface potential of the area in the photoconductor drum 12 exposed to the light beam changes to a predetermined level.

The electrostatic latent image formed on the surface of the photoconductor drum 12 is developed into a visible toner image on the photoconductor drum 12 by the corresponding developing unit 18.

Specifically, the developing unit 18 takes out a two-component developer from a development cartridge and spreads toner over the electrostatic latent image from a developing roller so that the toner is adhered onto the surface of the photoconductor drum 12.

With regard to the developer in this case, a carrier having a function for transporting the toner remains on the developing roller, and only the toner is transferred to the photoconductor drum 12.

Subsequently, the color toner images formed on the respective photoconductor drums 12 are transferred, by the transfer rollers 20, onto a sheet 28 traveling through the sheet transport path. After the sheet 28 undergoes the transfer process, the toner images formed on the sheet 28 are heated, pressed, and transported by the fixing unit 30, so that the toner becomes fused and solidified, whereby the toner becomes fixed onto the sheet 28. After the fixing process, the sheet 28 is output by an output roller, and the image forming process ends.

Light-Emission Control

Signal Generation

The AND circuit 170 in the light-emission-time controller-driver 162A receives a trigger signal and image data. The AND circuit 270 outputs the trigger signal to the PDOMV 260 only when the image data is ON. The PDOMV 260 receives nonuniform-density correction data, a reference clock, and the trigger signal. When the image data is ON, the PDOMV 260 generates light-emission pulses for the number of reference clocks corresponding to the nonuniform-density correction data.

A light-emission pulse is output to the AND circuit 267 and the OR circuit 268 and is also split and output to the delay circuit 264-0. The light-emission pulse is delayed by a predetermined time at the delay circuit 264-0 and is output to the delay-signal selecting unit 265. A light-emission pulse CKi delayed at the delay circuit 264-0 is also output to the delay circuit 264-1. Each of the delay circuits 264-1 to 264-7 receives a light-emission pulse CKi from the preceding delay circuit 264, delays the light-emission pulse by a predetermined time, and outputs the delayed light-emission pulse to the delay-signal selecting unit 265 and the subsequent delay circuit 264. However, the delay circuit 264-7 does not output the light-emission pulse to the subsequent delay circuit 264.

The delay-signal selecting unit 265 selects any one of the light-emission pulses CKi output from the delay circuits 264-0 to 264-7 based on the delay selection data stored in advance in the delay selection register 266. The selected light-emission pulse is output to the AND circuit 267 and the OR circuit 268.

The AND circuit 267 generates a light-emission pulse CK1, which is a logical product of a pre-delayed light-emission pulse and a delayed light-emission pulse, and outputs the light-emission pulse CK1 to the light-emission-signal selecting unit 269.

The OR circuit 268 generates a light-emission pulse CK2, which is a logical sum of a pre-delayed light-emission pulse and a delayed light-emission pulse, and outputs the light-emission pulse CK2 to the light-emission-signal selecting unit 269.

The light-emission-signal selecting unit 269 selects one of the output from the AND circuit 267 and the output from the OR circuit 268 based on the light-emission-signal selection data stored in advance in the delay selection register 266. The selected light-emission pulse (i.e., light-emission control signal (I)) is output to the LPH 16 via the MOSFET 272A if the signal switching unit 273 has switched toward the image-data light-emission-signal output unit 272.

SLED-Chip Operation Control

Next, the operation of the SLED chips 62 of the LPH 16 will be described with reference to timing charts shown in FIGS. 10 and 11.

Figure 10:
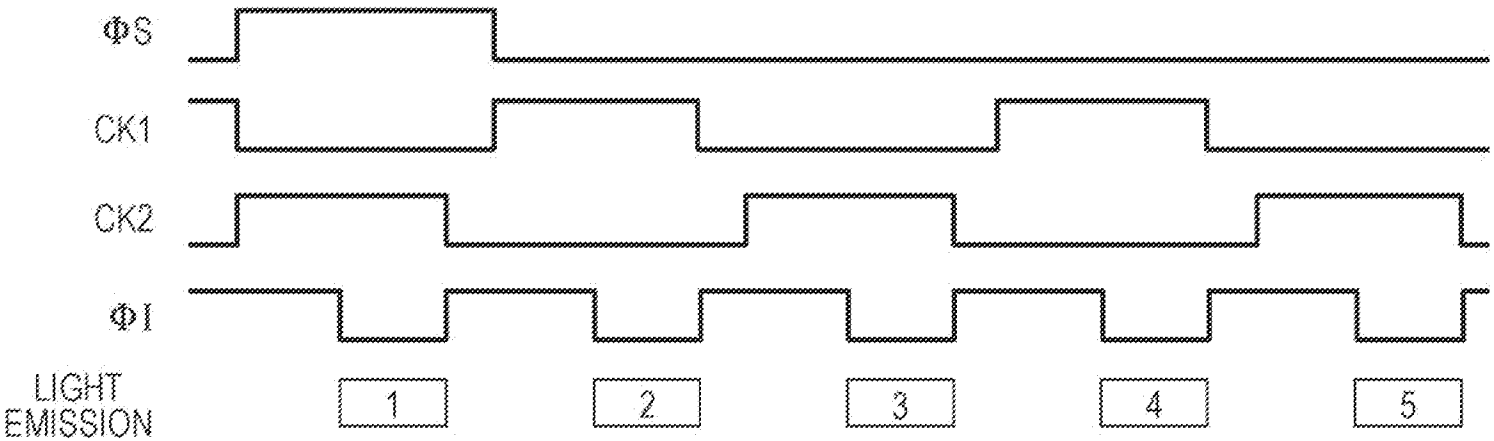
FIG. 10 is an operational timing chart (1) of each SLED chip in the LPH according to the exemplary embodiment.
Figure 11:
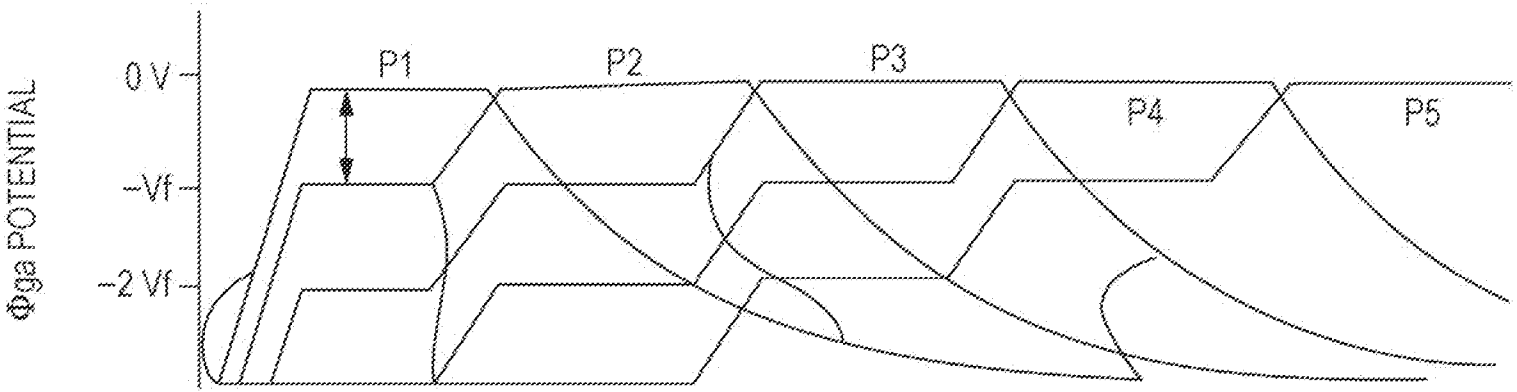
FIG. 11 is an operational timing chart (2) of each SLED chip in the LPH according to the exemplary embodiment.

As shown in FIGS. 10 and 11, a start signal $\phi S$ (CKS) is set to a high (H) level so that the potential at the point P1 becomes H level and the potential at the point P2 connected to the point P1 via a diode 92 becomes P2 $=\phi S-Vf$ (due to a voltage decrease in LED). Likewise, the potential at the point P3 becomes P3 $=$P2 $-Vf$, the potential at the point P4 becomes P4 $=$P3 $-Vf$, the potential at the point PN becomes PN$=$P(N$-$1)$-Vf$, and so on. However, the potential does not decrease to $\phi ga$ or lower since saturation occurs at a potential of $\phi ga$.

When CK1 becomes a low (L) level, the thyristor 90 corresponding to the point P1 is turned on. In this case, the potential $\phi S$ at the point P1 becomes 0 V, and the potential $\phi$1 of CK1 becomes −Vf. With regard to a point P equivalent to the point P1, that is, an odd-numbered point P, the thyristor 90 corresponding thereto is not turned on since the potential is decremented by 2Vf.

By changing OT from H to L in this state, the LED 60 in the first stage emits light. By changing ϕI from L to H, the LED 60 in the first stage is turned off. In this case, the potential of ϕI becomes −Vf.

Subsequently, by setting CK2 to L, the thyristor 90 corresponding to the point P2 is turned on so that P2=0 V, P3=−Vf, and P4=−2Vf. In this case, since the potential ϕ2 of CK2 becomes −Vf, the thyristors 90 corresponding to the points P4 and onward in the even-numbered stages are not turned on.

In a state where the thyristor 90 corresponding to the point P2 is turned on, CK1 is set to H so that the thyristor 90 corresponding to the point P1 is turned off, whereby the LED 60 in the first stage does not emit light in response to a subsequent data signal.

In this state, ϕI is changed from H to L so that the LED 60 in the second stage emits light. In this case, the potential of ϕI becomes −Vf. The ϕI is changed from L to H so that the LED 60 in the second stage is turned off (the potential of ϕI becomes 0 V).

The on state (and the light emission) of the thyristor (and the LED 60) in each odd-numbered stage is controlled by CK1, the on state (and the light emission) of the thyristor 90 (and the LED 60) in each even-numbered stage is controlled by CK2, and the exposure light quantity by each LED 60 is controlled by the light-emission, control signal ϕI.

Forced-Light-Emission Control

As shown in FIG. 5A, when sub scanning is performed in the following order: n-th line, (n+1)-th line, (n+2)-th line, . . . , (n+i)-th line, each main scanning line of each SLED chip 62 has non-writing periods as intervals between writing periods.

The LEDs 60 emit light in each writing period, whereas the LEDs 60 do not emit light in each non-writing period, thus causing a voltage fluctuation to occur between the writing period and the non-writing period. This may sometimes lead to the occurrence of streakiness in the sub scanning direction at a juncture of each SLED chip 62 (see the dotted line (comparative example) in FIG. 9).

In this exemplary embodiment, control is performed such that the LEDs 60 are forcedly made to emit light even during a non-writing period (i.e., an idle period), so that the voltage fluctuation may be suppressed (see the solid line (exemplary embodiment) in FIG. 9) as compared with a case where the LEDs 60 do not emit light, thereby preventing a lack of light quantity during a start-up of each SLED chip 62.

Figure 12:
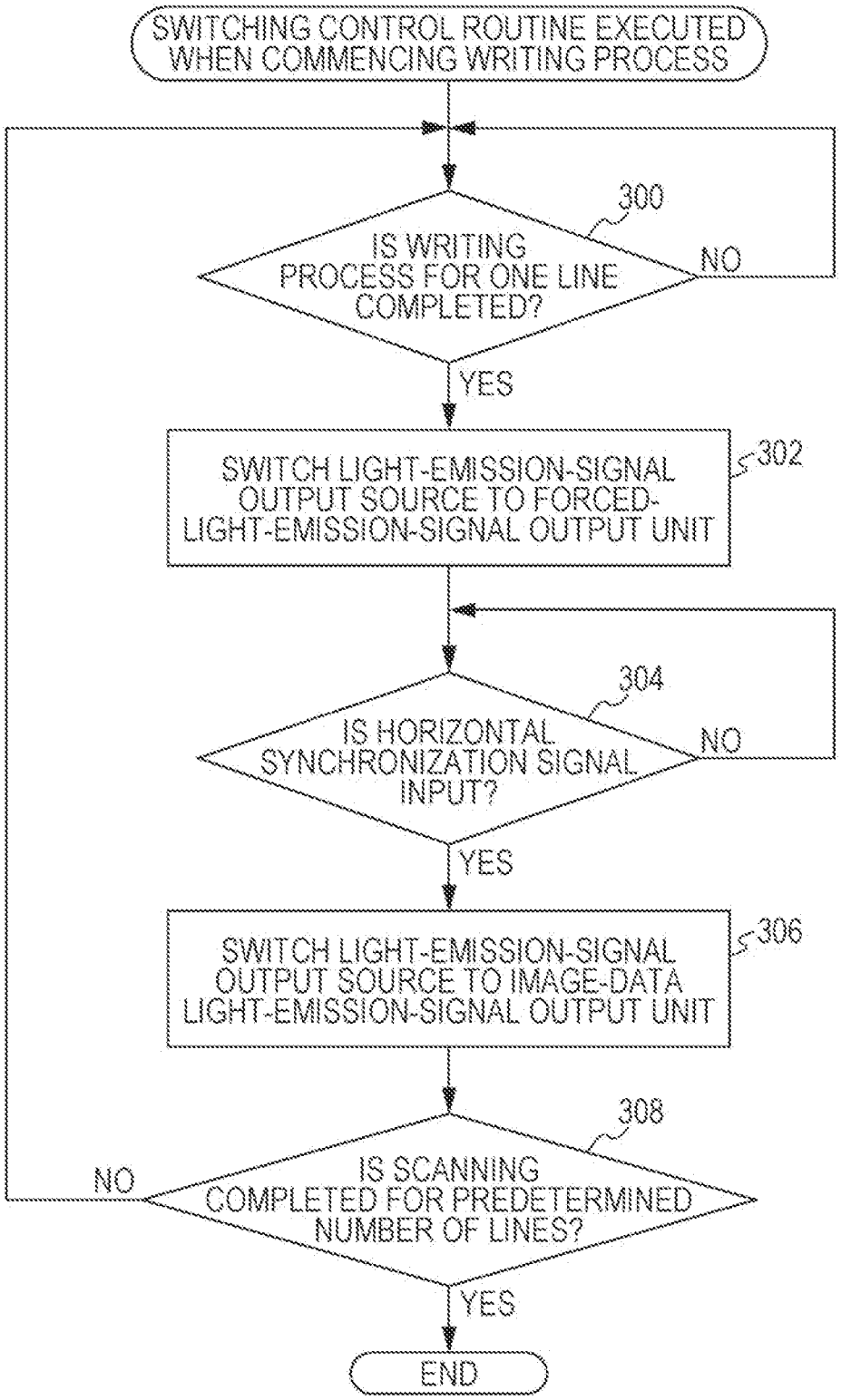
FIG. 12 is a flowchart illustrating alight-emission-signal switching control routine executed by a signal switching unit of the light-emission-time controller-driver according to the exemplary embodiment.

FIG. 12 is a flowchart illustrating alight-emission-signal switching control routine executed by the signal switching unit 273 shown in FIG. 6. Although the flow of processing will be described with reference to the flowchart, the processing is not limited to light-emission-signal switching control based on so-called software. In view of the processing speed, a logical circuit may be established by using an electronic component that includes a switching circuit, such that the light-emission-signal switching control may be executed based on hardware.

The flowchart shown in FIG. 12 commences in synchronization with a writing process. In step 300, it is determined whether or not a writing process for one line has been completed. This determination process is looped until a positive determination result is obtained. This looping period corresponds to a writing period shown in FIGS. 8A and 8B in which the SLED chips 62 execute main scanning.

When a positive determination result is obtained in step 300, the processing proceeds to step 302 where the light-emission-signal output source is switched to the forced-light-emission-signal output unit 275. The processing then proceeds to step 304. Due to this switching, the LEDs 60 are forcedly made to emit light during a non-writing period. Since the light forcedly emitted from the LEDs 60 is limited to an exposure light quantity that does not lead to exposure, the light does not affect the image quality.

In step 304, it is determined whether or not (a start-up of) a horizontal synchronization signal is detected. If a positive determination result is obtained, the processing proceeds to step 306 where the light-emission-signal output source is switched to the image-data light-emission-signal output unit 272. The processing then proceeds to step 308.

In step 308, it is determined whether or not the scanning has been completed for a predetermined number of lines, for example, lines equivalent to a single page. If a negative determination result is obtained, the processing returns to step 300 so as to repeat the above-described process. On the other hand, if a positive determination result is obtained in step 308, the routine ends.

With the switching control described above, the signal switching unit 273 switches the output source to the image-data light-emission-signal output unit 272 during a writing period (see FIGS. 5A and 5B), and switches the output source to the forced-light-emission-signal output unit 275 during a non-writing period (see FIGS. 5A and 5B).

As a result, the light-emission control signal (I) is changed from the comparative example indicated by the dotted line in FIG. 9 to the exemplary embodiment indicated by the solid line in FIG. 9, so that electric power is continuously consumed even during a non-writing period (i.e., an idle period), whereby a voltage fluctuation may be suppressed.

Modifications

In this exemplary embodiment, in order to suppress a voltage fluctuation during a non-writing period, the LEDs 60 are forcedly made to emit light that does not lead to exposure. As a solution for suppressing a voltage fluctuation other than forcedly making the LEDs 60 emit light, the following solutions may be applied.

First Modification in the drive circuit of each SLED chip 62, transfer thyristors (thyristors 90) that do not affect other components and reset thyristors (not shown) for turning off the LEDs 60 in the light emitting state may be driven (continuously turned on or repeatedly turned on and off) during a non-writing period.

Second Modification

The electric power (electric current) consumed by the light-emission-time controller-driver 162A or an application specific integrated circuit (ASIC) used in the drive circuit of each SLED chip 62 is increased. For example, in the case of the light-emission-time controller-driver 162A, a clock generated at the PDOMV 260 may be quickened, or a wasteful calculation process may be intentionally performed in a calculation process at the delay-signal selecting unit 265.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is Claimed is:

1. A light scanning device comprising:

a scanning unit that faces a scan surface and that performs scanning by dividing one scan area into segments by having a plurality of light-emitting-element groups arranged in a predetermined scanning direction, each light-emitting-element group writing an image onto the scan surface by causing a plurality of light-emitting elements arranged in the scanning direction to emit light in a time-division manner based on image information;

an light-emission signal output unit that outputs an light-emission signal causing the plurality of light-emitting-element groups to emit image light corresponding to the image information only during each writing period; and a power consumption unit that operates during each non-writing period occurring between writing periods repeatedly executed in each light-emitting-element group, the power consumption unit outputting a forced-light-emission-signal only during the non-writing period causing consumption of electric power corresponding to electric power consumed for light emission in the light-emitting-element group during the writing period.

2. The light scanning device according to claim 1, wherein the power consumption unit causes the light-emitting elements to emit light with a light quantity that does not affect the scan surface.

3. The light scanning device according to claim 1, wherein the scanning unit is a self-scanning light-emitting-element unit that includes a head section that has the light-emitting-element groups arranged in a direction that intersects with the scanning direction such that a relative distance between the light-emitting elements located at ends of adjacent light-emitting-element groups is equal to a relative distance between the light-emitting elements in each light-emitting-element group, and a drive circuit that is driven by being controlled based on control signal information including a light-emission time, the control signal information being transmitted sequentially in accordance with the scanning direction.

4. The light scanning device according to claim 3, wherein the drive circuit is an integrated circuit that controls the light-emission time of all of the light-emitting elements in the light-emitting-element groups, and the consumption of the electric power is caused by making the integrated circuit execute an unnecessary calculation process during the non-writing period.

5. An image forming apparatus comprising:

the light scanning device according to claim 1;

an image bearing member that includes the scan surface; and an image forming unit in which a direction in which the scanning unit scans the light emitted by the light-emitting elements is defined as a main scanning direction, and that forms an image onto the scan surface on the image bearing member by causing the scanning unit and the image bearing member to move relatively to each other in a sub scanning direction that intersects with the main scanning direction.

6. The light scanning device according to claim 1, wherein the power consumption unit outputs a constant voltage light-emission control signal causing the plurality of light-emitting elements to consume electric power during the non-writing period.

7. The light scanning device according to claim 1, wherein each light-emitting-element group comprises light-emitting diodes as light-emitting elements.

* * * * *